US006539557B1

(12) United States Patent
Avila

(10) Patent No.: US 6,539,557 B1
(45) Date of Patent: Apr. 1, 2003

(54) TOILET SEAT POSITIONING ASSEMBLY

(76) Inventor: Rodrigo E. Avila, Vipsal 2816 P.O. Box 02-5369, Miami, FL (US) 33102-5364

( * ) Notice: Subject to any disclaimer, the term of this patent is extended or adjusted under 35 U.S.C. 154(b) by 0 days.

(21) Appl. No.: 09/915,635

(22) Filed: Jul. 27, 2001

(51) Int. Cl.[7] ..... A47K 13/10
(52) U.S. Cl. ..... 4/240; 4/246.1
(58) Field of Search ..... 4/246.1, 236, 240

(56) References Cited

U.S. PATENT DOCUMENTS

| | | | | |
|---|---|---|---|---|
| 1,529,656 A | | 3/1925 | Kornhauser | 4/240 |
| 2,181,017 A | | 11/1939 | Hill | 1/240 |
| 3,060,458 A | | 10/1962 | Burke | 4/237 |
| 3,925,833 A | | 12/1975 | Hunter | 4/667 |
| 4,055,864 A | * | 11/1977 | Liu et al. | 4/246.1 X |
| 4,091,473 A | | 5/1978 | Matthews et al. | 4/420 |
| 4,150,446 A | | 4/1979 | Crocker | 4/246.3 |
| 4,168,552 A | | 9/1979 | Austin | 4/237 |
| 4,438,535 A | | 3/1984 | Paredes | 4/234 |
| 4,780,914 A | | 11/1988 | Lin | 4/236 |
| 4,995,120 A | * | 2/1991 | Tager | 4/246.1 |
| 5,307,524 A | * | 5/1994 | Veal | 4/246.1 |
| 5,592,703 A | | 1/1997 | Jones et al. | 4/667 |
| 5,819,325 A | | 10/1998 | Richards | 4/237 |
| 5,978,974 A | | 11/1999 | Mullen | 4/246.5 |
| 6,112,335 A | | 9/2000 | Gaston | 4/246.1 |

* cited by examiner

*Primary Examiner*—Robert M. Fetsuga
(74) *Attorney, Agent, or Firm*—Malloy & Malloy, P.A.

(57) ABSTRACT

A positioning assembly structured to orient a toilet seat in either a raised or lowered position including a drive assembly comprising an electrically powered, reversible drive motor rotationally connected to a drive shaft. The drive shaft rotationally drives a hinge assembly pivotally mounting the toilet seat to a toilet bowl. A control assembly includes a manually operable switch assembly, which may be in the form of a foot pedal or other activatible control facility. The drive assembly, while having sufficient output capacity to move the seat may be of a size which facilitates its mounting on the toilet bowl, adjacent the seat and in direct driving relation to the hinge assembly. The drive assembly may be a integrated component of the toilet seat assembly when purchased or otherwise be structurally adapted for use with existing, previously installed toilet seats.

7 Claims, 3 Drawing Sheets

TOILET SEAT POSITIONING ASSEMBLY

BACKGROUND OF THE INVENTION

1. Field of the Invention

This invention is directed to a toilet seat positioning assembly, which is electrically powered to selectively raise and/or lower the toilet seat by manual activation of a control switch preferably, but not necessarily, comprising a foot pedal assembly.

2. Description of the Related Art

In most households it is common practice for more than one individual of the same family or group to share the same toilet facilities. Female members of the family or household community require that the toilet seat be placed in lowered position so as to directly overly the toilet bowl. To the contrary, male members of the family normally prefer the toilet seat to be in an oppositely disposed, raised position during the performance of at least some of the normal bodily functions. Because of the necessity to share the same toilet, it is a common complaint of both male and female family members that other members, of the opposite gender, tend to leave the toilet in the "wrong" position. This of course requires the current user of the toilet to position the seat in the preferred orientation.

Therefore, both male and female users encounter the same problem when required to manually orient the toilet seat into a preferred position by physically contacting the exposed, outer or under surfaces of the toilet seat. Contact with the toilet seat obviously exposes the user to potentially hazardous health conditions by coming into direct contact with bacteria, germs, etc. from bodily fluids which may have inadvertently contacted the toilet seat. Moreover, the raising or lowering of a toilet seat may be difficult for younger children, physically handicapped individuals or the elderly. Such individuals may have difficulty in bending or otherwise positioning themselves so as to locate the toilet seat in a preferred orientation. In the case of infants or younger children, it is not uncommon for the toilet seat to be inadvertently dropped into the lowered position, possibly resulting in injury if the toilet seat falls on a child's hand, finger, etc.

In recognition of the disadvantages and problems of the type set forth above, there have been numerous attempts to design a lifting or positioning device structured to facilitate the automatic raising and/or lowering of the toilet seat. As used herein and as commonly recognized in this field, the term "automatic" is generally meant to be descriptive of a variety of devices which selectively position the toilet seat without requiring the user to touch, grip or otherwise come into direct contact with it.

In spite of the recognition of the problems associated with positioning the toilet seat and the many attempts to design and/or produce automatic toilet seat positioning devices, it is obvious that there is a scarcity of such positioning devices being commercially offered to the public or in actual use by the general population. A review of representative attempts to design an efficient, commercially attractive toilet seat positioning device clearly indicates that such known devices appear to be extremely complicated, rendering them difficult to install and possibly less than totally reliable for continued, repetitive operation.

More specifically, known attempts to overcome the problems and disadvantages associated with positioning a toilet seat for use, as generally set forth above, typically involve manually or hydraulically powered devices. Such devices frequently comprise an assembly of articulated components, including elongated arms and/or lifting devices, which are pivotally attached to one another. Moreover, this collection of interactive components are secured to some portion of the toilet seat, such as about the peripheral edge or along the under surface thereof.

A well known category of prior art or known devices include a foot activated lever or pedal assembly, wherein manual force applied thereto facilitates the positioning of the toilet seat in the desired orientation by the interaction of the plurality of the interconnected components. In addition, foot activated assemblies may also include force generating piston and cylinder assemblies utilizing some type of hydraulic fluid or air to raise and lower the toilet seat. By way of example, the outer most end of the piston is connected to the toilet seat and may be forced into an outwardly extended or inwardly retracted position in order to obtain the desired orientation of the toilet seat.

Another category of toilet seat positioning devices incorporates the use of some type biasing structure or spring assembly, which is mounted in direct association with a hinge serving to pivotally connect the toilet seat to the toilet bowl for proper positioning thereof. In this category of devices the toilet seat is usually biased into a vertical or at least partially raised orientation, thereby requiring that the user touch or otherwise engage the exposed surfaces of the toilet seat in order to orient it into the lowered position.

Yet even more complicated toilet seat positioning devices are designed to aid the physically challenged or incapacitated, elderly individuals. Such devices involve structural features which allow for the temporary detachment of the toilet seat from the toilet bowl and the orientation thereof outwardly into a position which is more easily accessible by a handicapped or incapacitated individual. Such devices may also be operated by a variety of different types of control or switching assemblies. Control devices of this type may be either foot or hand operated so as to selectively position the toilet seat back into an operative position, while the seat at least partially bears the weight of the individual in order to aid his or her positioning relative to the toilet bowl.

A review of the various categories of automatic toilet seat positioning devices, of the type generally set forth above, provides a clear indication that the lack of commercial acceptance by the consuming public is based, at least to a large extent, on the fact that such devices are unattractive when installed and generally not "consumer friendly". More specifically, numerous known devices are overly complex, difficult and cumbersome to operate, require considerable amount of space for their operative positioning and are difficult, if not impossible, to install without specialized tools or specific experience or training in the operation and structure of such positioning devices.

Therefore, there is a recognized need in this area for an improved automatic toilet seat positioning assembly which is effective and efficient in its operation and consistently reliable for continuous and/or repetitive use. If any such improved toilet seat positioning assembly were developed, it should be compact in its design and structure, safe and reliable in its operation and capable of being easily and quickly installed, particularly by women consumers, without the use of expensive and/or complicated tools or equipment. In addition, the structural and design features of any such improved toilet seat positioning assembly should be such as to allow its purchase as part of the toilet seat assembly. As such, both the positioning assembly and toilet seat can be installed as an integrated unit in a manner substantially similar to that used to install a conventional toilet seat. Alternatively, any improved positioning assembly should be capable of being sold and purchased independently and structurally adaptable to be easily and quickly installed on existing toilet seat structures.

SUMMARY OF THE INVENTION

The present invention is directed to a toilet seat positioning assembly structured to selectively orient a toilet seat in either a raised or lowered position relative to the toilet bowl on which it is mounted without requiring the user to grip or otherwise directly contact the toilet seat. The positioning assembly of the present invention is distinguishable, at least in part, from known or conventional toilet seat lifting devices by virtue of its efficiently compact size. As such, at least a portion of the positioning assembly may be mounted on an upper expose surface of the base of the toilet bowl, to which the seat is secured and substantially adjacent to or at least partially within a hinge assembly associated with the toilet seat. In addition, the versatility and adaptability of the positioning assembly of the present invention is such as to allow it to be commercially available to the consuming public as an integrated, working part of a toilet seat. The toilet seat positioning assembly is adaptable, with little or no structural modification, to be operatively connected to an existing, previously installed toilet seat in an effective manner without requiring the use of complicated or specialized tools or any unusual mechanical proficiency.

More specifically, the toilet seat positioning assembly of the present invention comprises a drive assembly including a drive motor which is preferably electrically powered and rotatably connected to a drive shaft. The drive shaft is connected in rotationally driving relation to the hinge assembly, or at least the portion thereof which serves to pivotally connect the toilet seat to a base of the toilet bowl. In typical fashion, by virtue of such pivotal connection the toilet seat is capable of being disposed in either a raised or lowered position. Accordingly, the drive motor is specifically structured to be reversible so as to selectively rotate the drive shaft, and accordingly the portion of the hinge to which the drive shaft is attached, in opposite directions. Therefore, the user of the positioning assembly of the present invention will have the ability, through manipulation of an associated control assembly, to either raise or lower the toilet seat thereby placing it in the desired orientation for use.

In at least one preferred embodiment, to be described in greater detailed hereinafter, the control assembly includes a manually activatable switch which comprises one or more foot pedals. The foot pedals, or other manually activatable switch assembly is electrically connected to the drive motor by conventional electrical conductors. In addition, the control assembly includes operative circuitry associated with an electrical power source for activating the drive motor when the foot pedal or other switching assembly is employed. Moreover, the control assembly is structured to selectively control the operation of the drive motor in either of two opposite directions so as to accommodate the raising or lowering of the toilet seat, as set forth above.

It is emphasized that the switching assembly associated with the control assembly may assume forms other than a foot activated pedal structure. By way of example, the switching assembly could be associated with a somewhat conventional wall mounted flip or double-throw switch or similar structure. In a more sophisticated example, the switching assembly could be sound and/or light activated. By way of example only, the drive motor could automatically raise and/or lower the toilet seat upon the activation of a light source within the bathroom facility or the emanation of a sound from the user, such as by the clapping of hands.

Other structural and operative features of the positioning assembly of the present invention include a housing or casing in which the drive motor is mounted, being sufficiently structured to prevent exposure of the drive motor or any electrical connections or components associated therewith, to any liquid. The drive motor housing, while being of reduced size to enable its mounting substantially adjacent the toilet seat, could be made of a light weight yet strong, durable material, so as to restrict unauthorized or inadvertent access to the drive motor and/or drive gear assembly associated therewith, by children, pets, etc.

One of the many structural and operative features of the toilet positioning assembly of the present invention which renders it more practical, and therefore more commercially attractive, is the ability to mount the drive assembly in an extremely small space and in direct driving connection with the hinge assembly pivotally securing the toilet seat to the toilet bowl. Moreover, the structural features of the positioning assembly, as well as its compact size, allow it to be commercially available as an operative component of a toilet seat assembly, wherein the toilet seat and the positioning assembly could be commercially available as a kit or unitary operable unit.

Alternatively, with little or no structural modification, the positioning assembly of the present invention could be adapted for removable connection to an existing, previously installed toilet seat. Therefore, included in one or more of the preferred embodiments of the present invention is the provision of an adaptor. The adaptor serves to drivingly connect the drive shaft to at least a portion of the hinge assembly of the toilet seat and may be structured to establish a fixed or removable attachment therebetween.

In either of the above noted embodiments, installation and/or adaptability of the positioning assembly of the present invention to a toilet seat would primarily involve the mounting of the toilet seat on the toilet bowl. In the conventional fashion, mounting bolts are positioned to pass through preexisting holes formed in the porcelain base of the toilet bowl. The securement of such mounting bolts is easily accomplished by means of any applicable bolt fasteners, nuts, or like connectors. When the toilet seat is mounted in this conventional fashion, the drive assembly, including the drive motor and drive shaft, could be fixedly or removably positioned on an exposed surface of the base of the toilet bowl. In such an embodiment, the drive motor would be disposed substantially adjacent to the toilet seat such that the drive shaft is disposed in direct driving connection to a portion of the hinge assembly which is secured to and moves with the toilet seat.

In yet another preferred embodiment the drive assembly, being of a significantly compact and reduced size, is mounted adjacent the toilet seat and at least partially within one of two hollow, annular sockets or channels which accompany most conventional hinge assemblies for toilet seats. The drive shaft associated with the drive motor fixedly connected in driving relation to the portion of the hinge assembly which rotates with the toilet seat as it is raised or lowered into a preferred position.

Therefore, installation of the positioning assembly of the present invention is extremely simple, in any of its preferred embodiments, since it primarily involves the interconnection of the toilet seat and toilet bowl in the conventional fashion, as set forth above.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
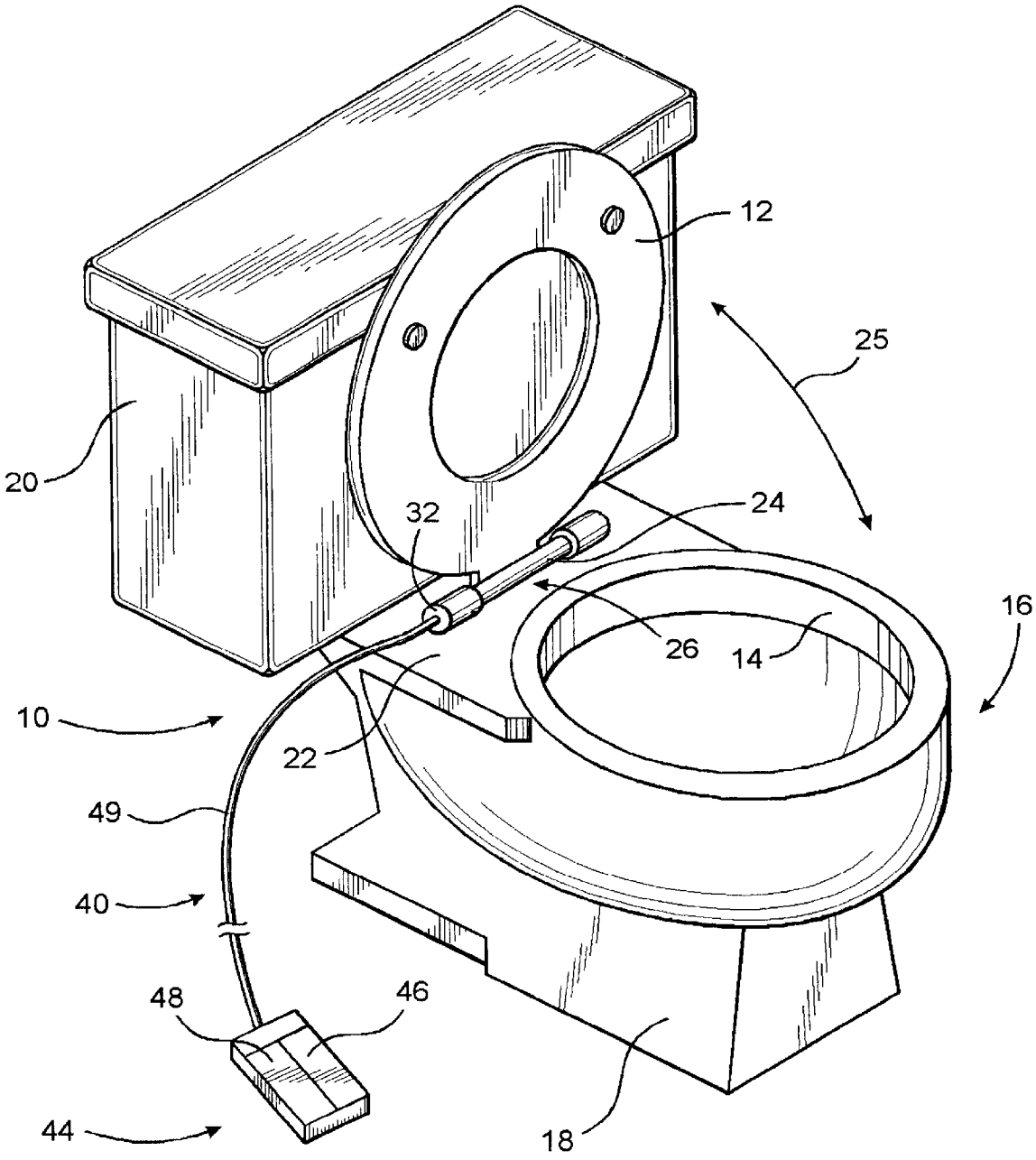
FIG. 1 is a perspective view of a toilet with an associated toilet seat disposed in a raised position and with one preferred embodiment of the toilet seat positioning assembly of the present invention operatively installed.
Figure 1A:
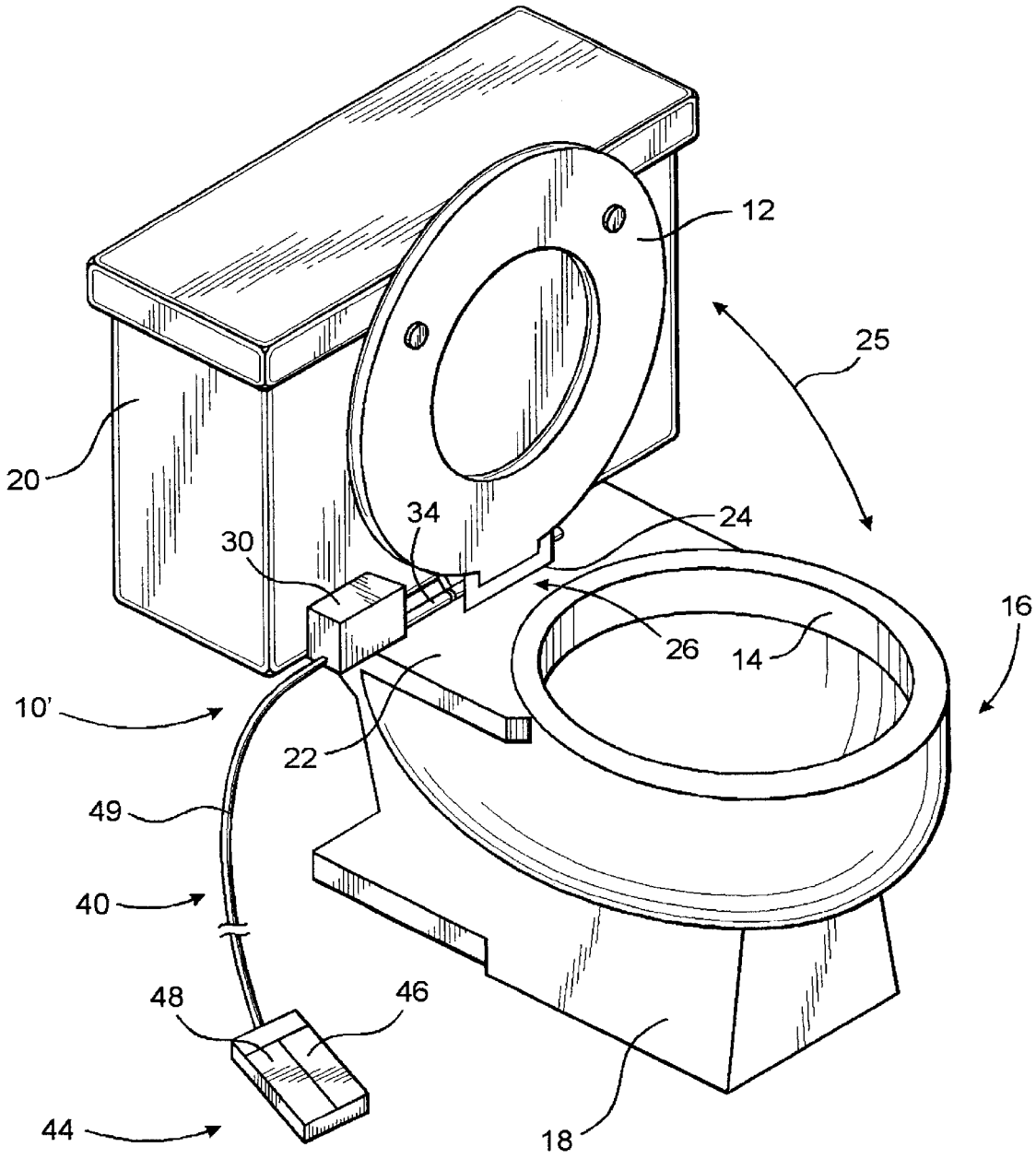
FIG. 1A is a perspective view of a toilet with an associated toilet seat disposed in a raised position and with another preferred embodiment of the toilet seat positioning assembly of the present invention operatively installed on the toilet bowl.

As shown in the accompanying Figures, the present invention is directed to a toilet seat positioning assembly, wherein the various preferred embodiments are generally indicated as 10 and 10'. Each of the positioning assemblies 10 and 10' are structured to orient a toilet seat 12 in either a raised position, as shown in FIGS. 1 and 1A, or a lowered position. In the lowered position (not shown) the toilet seat 12 overlies the entrance or opening 14 of a conventional toilet bowl 16. In addition, the toilet seat 12 may have an accompanying lid of a variety of different and/or somewhat conventional or standard sizes and configurations, which at least partially correspond to the size and shape of the toilet seat.

The toilet bowl 16 may be of various, relatively standard sizes or configurations and includes a support platform 18 and a water closet or tank 20 associated therewith. Moreover, the toilet seat 12 is conventionally secured to an upper base portion 22 of the toilet bowl 16 in a conventional fashion, such as by normally using two mounting bolts which are connected to a base portion 24 of the toilet seat 12. While not specifically shown, the two mounting bolts normally pass through pre-formed channels or holes formed in the rear of the upper base 22 of the toilet bowl 16. The outer or distal end of each of the mounting bolts are externally threaded or otherwise structured to receive bolt connectors, nuts or other attachment devices which securely mount the toilet seat base 24 to the upper base portion 22 of the toilet bowl 16.

Figure 2:
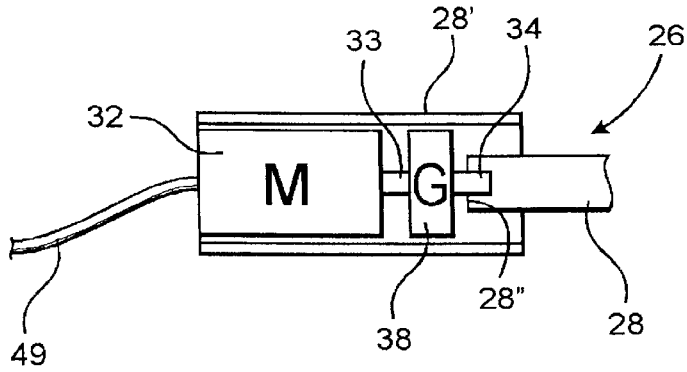
FIG. 2 is a schematic representation of the various operative components of a drive assembly of the embodiment of FIG. 1 and its association with a hinge assembly pivotally mounting the toilet seat on the toilet bowl.
Figure 2A:
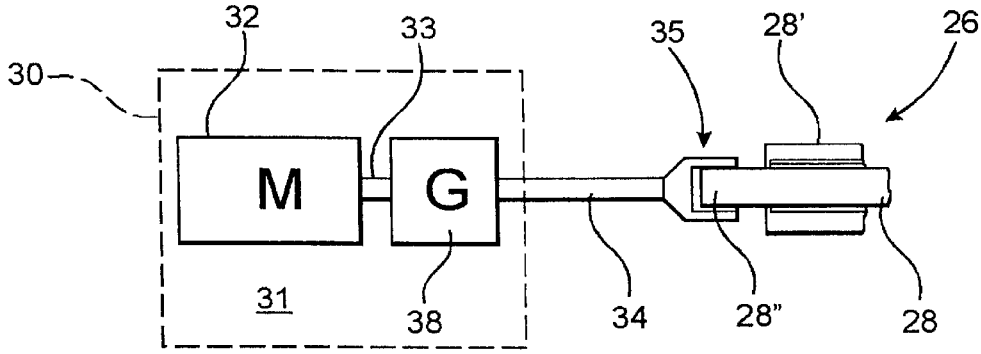
FIG. 2A is a schematic representation of the various operative components of a the drive assembly and its attachment to a hinge assembly associated with the preferred embodiment of FIG. 1A.
Figure 3:
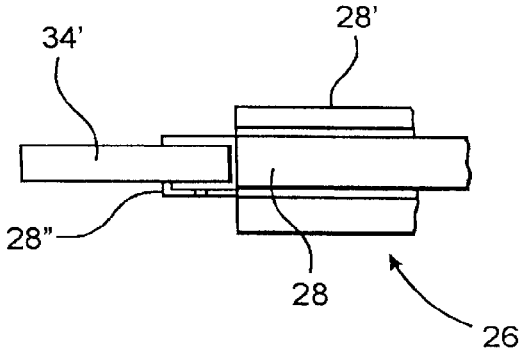
FIG. 3 is schematic representation of another embodiment relating to the attachment of the drive assembly to the hinge assembly which differs from the embodiment of FIG. 2A.

In each of the preferred embodiments of FIGS. 1 and 1A, the toilet seat 12 is pivotally connected to the toilet bowl 16 and more specifically to the upper base portion 22 thereof by a hinge assembly, generally indicated as 26. The hinge assembly 26 may be directly associated with a toilet seat base 24 and may comprise a variety of different structures, as is well known in the manufacturing and mounting of toilet seats. By way of example only, the hinge assembly may include outwardly extending fingers or the like as at 28 fixedly secured to the toilet seat 12 so as to move therewith. The fingers pass into annular receiving channels or sockets 28' which are schematically represented in FIGS. 2, 2A and 3 and which, along with the fingers 28, at least partially define the aforementioned hinge assembly 26. Both the fingers 28 and the annular sockets 28' may be formed of a plastic or other material which presents a minimum frictional resistance and minimizes binding as the fingers 28 of the toilet seat 12 rotate or pivot within the interior of the annular sockets 28'. As set forth above, a variety of other structural configurations can be employed in the hinge assembly 26 which is used to pivotally secure the toilet seat 12 to the toilet bowl 16 thereby enabling it to be positioned between a raised and lower positioned as indicated by the directional arrow 25.

One preferred embodiment of the present invention as shown in FIGS. 1 and 2 is generally indicated as 10 and comprises a drive assembly including a drive motor 32 and a drive shaft 34. As emphasized above the drive motor 32 may assume a significantly small and compact size. As such, the drive motor 32 is dimensioned to be at least partially mounted within the annular channel or socket 28' which, as set forth above, defines a part of the hinge assembly 26. As shown in FIG. 2, the motor 32 includes a power take-off 33 connected to an appropriate gear assembly 38. The gear assembly 38 serves to interconnect the power take-off 33 to the drive shaft 34.

Accordingly, both the motor 32 and gear assembly 38 are positioned substantially adjacent the toilet seat 12 and within the interior of the annular socket 28', in fixed attachment and driving relation to the hinge portion 28 which is rotatable with the toilet seat 12. Further, in the embodiment of FIGS. 1 and 2, the motor 32 may be at least minimally exposed to an exterior of the hinge assembly 26 to facilitate connection to a control assembly, such as by conductor 49, as will be explained herein after. Therefore, at least to the extent described above, the drive motor 32 of the embodiment of FIGS. 1 and 2 may generally be considered to be incorporated as a part of the hinge assembly 26 and made commercially available therewith, as an integrated unit.

In the preferred embodiment of FIGS. 1A and 2A, the toilet seat positioning assembly 10 of the present invention is structurally and operatively adapted to be positioned in a location substantially adjacent the toilet seat 12 and in direct driving engagement with the hinge assembly 26 or at least the portion thereof 28 which is secured to and moves with the toilet seat 12, as will be described in greater detail with reference to FIGS. 2 and 3. The positioning assembly 10 comprises a protective housing or casing 30 having a hollow interior 31 of sufficient dimension and configuration to enclose a drive assembly. The drive assembly comprises a drive motor 32 and a drive shaft 34.

Figure 4:
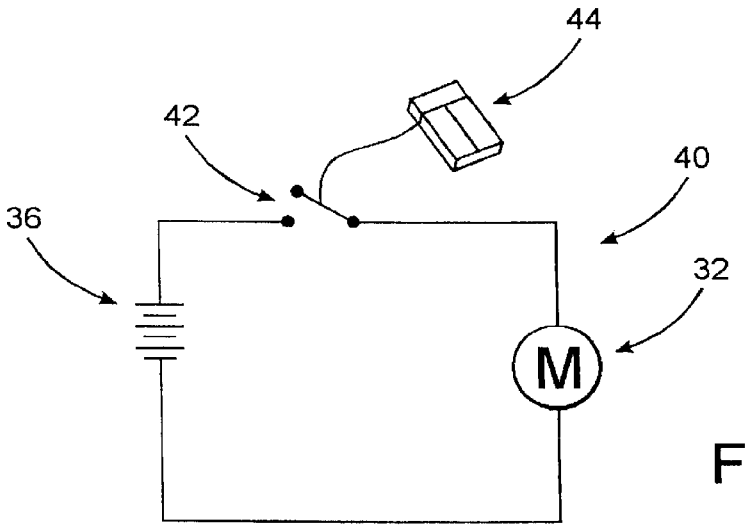
FIG. 4 is a simplified schematic diagram of at least a portion of the control assembly associated with the activation and operation of the positioning assembly of the present invention.

In both of the preferred embodiments of FIGS. 1 and 1A, the drive motor 32 is preferably electrically powered by means of its electrical interconnection to a source of electrical energy 36 schematically represented in FIG. 4. The source of electrical energy 36 may take the form of one or more replaceable or rechargeable battery packs. Alternatively, the source of electrical energy 36 may include a conventional electrical supply associated with the home or building in which a positioning assembly 10 is utilized. Further, in the embodiment of FIGS. 1A and 2A, the housing or casing 30 is cooperatively structured with the drive motor 32 so as to be light weight and small in size and configuration. Also, the casing 30 is preferably formed of a relatively high strength and durable material in order to protect the contents within the interior 31 from exposure to liquids and inadvertent or purposeful access by children, pets, etc.

In addition, the housing 30 may include or be associated with some type of mounting fixture or facility (not shown for purposes of clarity) which maintains a stable, operative positioning of the housing 30. When so positioned, the drive motor 32 and drive shaft 34, are operatively supported on the exposed surface of the upper base 22, substantially adjacent to the toilet seat 12 and in direct communication with the hinge assembly 26.

As set forth above, the installation of the positioning assembly and in particular the drive assembly are greatly simplified and facilitated, when compared to conventional or known lifting assemblies, by virtue of it being drivingly connected directly to the hinge assembly 26. More specifically, and with reference to FIGS. 2, 2A and 3 the drive shaft 34 extends outwardly from the gear assembly 38 into direct, rotational driving connection with the hinge assembly 26 and more specifically with the portion thereof 28 which rotates with the toilet seat 12. In the embodiment of FIG. 2A, the drive shaft 34 is interconnected in driving relation to the hinge portion 28 by virtue of an adaptor 35 mounted or fixed to the outer most end of the drive shaft 34 and engaging the distal or outer most end 28" of the hinge portion 28. By virtue of this connection, and similar to the embodiments of FIGS. 2 and 3, rotation of the drive shaft 34 in either of two opposite directions will cause pivotal movement of the toilet seat 12 in a corresponding direction so as to either orient the toilet seat 12 in a raised or lowered position as schematically represented by the directional arrow 25 of FIGS. 1 and 1A.

It should also be noted that the adaptor 35 may comprise anyone of a variety of structural configurations so as to establish fixed, driving engagement with an appropriate hinge portion of any one of a variety of different hinges which may be associated with the toilet seat 12. Therefore, the specific structure of the adaptor 35 may vary greatly depending on the structure and operative features of a particular hinge assembly associated with the toilet seat 12 and used to facilitate its pivotal movement relative to the toilet bowl 16 and the upper base portion 22, as described above.

With reference to FIG. 3, yet another embodiment of the present invention includes the drive shaft 34 directly fixed to the hinge portion 28 of the hinge assembly 26, such as by being permanently attached, or otherwise fixedly secured to the outer or distal end 28". In the embodiments of FIGS. 2 and 3 the drive shaft 34 and 34' may be integrally or otherwise fixed to the hinge portion 28 in order to establish a somewhat permanent connection between the hinge assembly 26 and the drive shaft 34 and 34'.

It is of course understood that the drive motor 32, while assuming a small size and compact configuration must have sufficient capacity to deliver enough rotational force at its power take-off 33 to rotate the connected portion 28 of the hinge assembly 26 in order to properly orient or position the toilet seat 12. In order to assure such rotational force, the various preferred embodiments of the drive assembly of the present invention may also include the aforementioned drive gear assemblies 38. The size and configuration of the respective gear assemblies 38 are such as to be mounted within the annular socket 28' or the interior 31 of housing 30 as respectively shown in FIGS. 2 and 2A. The gear assembly 38 serves to interconnect the drive motor 32 substantially at the power take-off 33 to the drive shaft 34. The gear assembly 38 may take a variety of different configurations and include a plurality of intermeshing gears of different sizes and locations so as to produce sufficient mechanical advantage between the power take-off 33 and the drive shaft 34. Efficient pivotal movement of the toilet seat 12, regardless of its size, weight, configuration, etc., is thereby assured by virtue of the drive shaft 34 being connected to at least portion 28 of the hinge assembly 26, as described above.

Another feature of a most preferred embodiment of the present invention is the provision of a control assembly generally indicated as 40 and disclosed in an operative position in FIGS. 1 and 1A and schematically in FIG. 4. The control assembly 40 comprises a switch assembly generally indicated as 42 which may be in the form of a manually activated device such as, but not limited to, a foot pedal 44. The foot pedal 44 may include one or more pedal members 46 and 48 which are cooperatively structured with appropriate electrical circuitry and which are electrically connected to the drive motor 32 by electrical conductor 49. The control assembly serves to activate the drive motor 32 and regulate its operation in a manner which selectively determines the rotation of the drive shaft 34 in opposite directions.

As set forth above, the drive motor 32 is electrically powered and reversible. Accordingly, appropriate circuitry, which may be of substantially known or conventional design, may be interposed between the switch assembly 42, 44 and the drive motor 32. The electrical circuitry incorporates and/or is directly associated with an appropriate source of electrical energy 36 and is thereby at least partially determinative of the activation and operation of the drive motor 32 in the selective raising or lowering of the toilet seat 12 as desired and as indicated by directional arrow 25. Therefore, it is emphasized that the simplistic schematic representation of FIG. 4 is representative only of substantially conventional and/or appropriately customized circuitry included within the control assembly 40. The control assembly 40 and the operative circuitry associated therewith facilitates the activation and operation of the electrically powered, reversible drive motor 32 to cause the selective orientation of the toilet seat 12, as set forth above.

Rather than the foot activated switch assembly, including the one or more pedals 46 and 48, the control assembly 40 could include a hand manipulated switching assembly (not shown) mounted on or associated with the housing 30. Yet another alternative to be included within the spirit and scope of the present invention is an appropriate switching assembly which may be wall mounted such as a conventional light switch. Alternatively, another embodiment of the switching assembly may be more sophisticated such as by being activated by illumination and/or sound, as generally set forth above.

Therefore, the toilet seat positioning assembly 12 of the present invention provides an extremely efficient means of automatically orienting a toilet seat 12 between a raised and/or lower position, as desired by the user. The structural and operative components thereof are of a compact design and configuration, presenting minimal installation difficulties other than the conventional mounting of the toilet seat 12 on the base portion 22 of the toilet bowl 16 in the manner generally described above.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A toilet seat assembly movably mounted on a toilet bowl, said toilet seat assembly comprising:

a) a seat secured to the toilet bowl, b) a hinge assembly connected to said seat and disposed and structured to facilitate pivotal movement of said seat between a raised position and a lowered position, c) a drive assembly connected in driving relation to at least a portion of said hinge assembly, d) said drive assembly comprising a drive motor at least partially mounted within said hinge assembly and interconnected in driving relation to said portion of said hinge assembly, and e) said drive assembly being electrically powered and structured to move said portion of said hinge assembly and said seat into at least one of said raised or lowered positions when said drive assembly is activated.

2. A toilet seat assembly as recited in claim 1 wherein said drive motor is reversible and cooperatively structured with said control assembly to move said toilet seat in substantially opposite directions.

3. A positioning assembly as recited in claim 2 wherein said control assembly comprises a pedal assembly structured to be foot activated.

4. A positioning assembly as recited in claim 3 wherein said pedal assembly is cooperatively structured with said drive assembly to selectively raise and lower the toilet seat relative to the toilet bowl.

5. A toilet seat assembly as recited in claim 1 further comprising a control assembly electrically connected to said drive motor and disposed in spaced relation therefrom.

6. A toilet seat assembly as recited in claim 5 wherein said control assembly comprises a foot activated switch assembly.

7. A toilet seat assembly as recited in claim 1 wherein said drive assembly further comprises a drive shaft connected in driven relation by said drive motor and in driving relation to said portion of said hinge assembly.

* * * * *